US006640819B2

(12) United States Patent
Höser et al.

(10) Patent No.: US 6,640,819 B2
(45) Date of Patent: Nov. 4, 2003

(54) CLEANING DEVICE FOR A SHAVING APPARATUS

(75) Inventors: Jürgen Höser, Neu-Anspach (DE); Alf Jahn, Halle/Saale (DE)

(73) Assignee: Braun GmbH (DE)

( * ) Notice: Subject to any disclaimer, the term of this patent is extended or adjusted under 35 U.S.C. 154(b) by 90 days.

(21) Appl. No.: 10/061,104

(22) Filed: Feb. 1, 2002

(65) Prior Publication Data

US 2002/0078984 A1 Jun. 27, 2002

Related U.S. Application Data

(63) Continuation of application No. PCT/EP00/07261, filed on Jul. 28, 2000.

(30) Foreign Application Priority Data

Jun. 8, 1999 (DE) ..... 199 37 167

(51) Int. Cl.[7] ..... B08B 3/04

(52) U.S. Cl. ..... 134/92; 134/111; 134/186; 134/166 R; 134/201; 134/188

(58) Field of Search ..... 134/92, 111, 186, 134/184, 166 C, 166 R, 201, 62, 116, 135, 901, 188

(56) References Cited

U.S. PATENT DOCUMENTS 3,172,416 A * 3/1965 Simmons
3,365,267 A * 1/1968 Kiney et al.
4,462,415 A * 7/1984 Otzen
5,143,101 A * 9/1992 Mor
5,161,559 A * 11/1992 Yoshihara et al.
5,421,353 A * 6/1995 Jakubowski
5,649,556 A * 7/1997 Braun

FOREIGN PATENT DOCUMENTS

| | | | |
|---|---|---|---|
| DE | 2429372 | * | 1/1976 |
| FR | 2568111 | * | 1/1986 |
| WO | WO 98/35581 | | 8/1998 |

* cited by examiner

*Primary Examiner*—Frankie L. Stinson
(74) *Attorney, Agent, or Firm*—Fish & Richardson PC

(57) ABSTRACT

The invention is directed to a cleaning device (RV) with a housing (1) and with a cleaning bath (8) for receiving an appliance of personal use, in particular a shaving head (S) of a shaving apparatus (R), with a replaceably arranged cleaning liquid container (3) having an inlet port (15) and an outlet port (18), a sealing element (51) for sealing the outlet port (18), a liquid impelling assembly (6) adapted to be driven by a motor (5) for propelling a cleaning liquid (11) from the cleaning liquid container (3) into the cleaning bath (8) whose draining conduit (9) is adapted to be coupled to an inlet port (15) of the cleaning liquid container (3), wherein provision is made for a sealing element (14) between the draining conduit (9) and the inlet port (15), and the flow cross section of the draining conduit (9) is dimensioned such as to enable the cleaning liquid (11) with contaminants to drain into the cleaning liquid container (3) and gaseous medium to escape from the cleaning liquid container (3).

21 Claims, 4 Drawing Sheets

CLEANING DEVICE FOR A SHAVING APPARATUS

This is a continuation of PCT application serial no. PCT/EP00/07261, filed Jul. 28, 2000, which claims priority from German application serial number 19937167.9, filed Aug. 6, 1999, (pending).

This invention relates to a cleaning device of the type identified in the prior-art portion of claim 1.

A cleaning device of the type initially referred to is known from PCT/EP98/00417. It is an object of the present invention to improve a cleaning device of the type initially referred to, in particular to reduce the evaporation of cleaning liquid from the cleaning liquid container.

According to the invention this object is accomplished by a cleaning device of the type initially referred to with the features of claim 1.

The cleaning device of the present invention has several advantages. One essential advantage of the invention is that, when the cleaning liquid container is coupled to the cleaning bath, the inlet port and the outlet port needed in the cleaning liquid container for circulation of the liquid are surrounded by sealing elements so that only the opening cross section required for circulation of the cleaning liquid with or without contaminants remains for evaporated cleaning liquid in the draining conduit to escape. The flow cross section of the draining conduit is dimensioned in accordance with the invention such as to enable the cleaning liquid with contaminants to drain into the cleaning liquid container and the gaseous volume needing to be displaced from the gas-tight cleaning liquid container due to this inflow of liquid to escape from the cleaning liquid container. These conditions can be guaranteed with a relatively small flow cross section of the draining conduit, thus enabling the amount of cleaning liquid lost due to evaporation while the cleaning device is not being used to be reduced to a minimum.

A preferred embodiment of the invention is characterized in that a pressure compensation conduit is associated with the draining conduit. In a further aspect of the invention a pressure compensation conduit is associated with the draining conduit as an integral component of the draining conduit. An essential advantage of this embodiment is that, instead of a separate sealing element being required to seal the pressure compensation conduit, said function can be performed as well by the sealing element surrounding the draining conduit.

In a further aspect of this embodiment provision is made for the pressure compensation conduit to be formed by a length of pipe. This provision ensures that while displaced gaseous medium is flowing out it is simultaneously separated from the inflow of cleaning liquid, thus guaranteeing that the cleaning liquid is reliably drained from the cleaning bath and gaseous volume escapes unobstructed from the interior of the cleaning liquid container under the action of cleaning liquid entering the container.

A further embodiment of the invention is characterized in that an overflow wall provided in the cleaning bath projects into the draining conduit. The second flow channel resulting from the overflow wall in the draining conduit promotes not only the return flow of cleaning liquid into the cleaning liquid container but also the displacement of gaseous volume from the cleaning liquid container thereby caused.

A further advantageous embodiment of the invention is characterized in that the flow cross section of the draining conduit is divisible by means of the pressure compensation conduit and the overflow wall into three flow channels, enabling each of the flow channels to be assigned a certain function.

A very simple and economical embodiment of the invention is characterized in that a sealing element is provided on the outer wall of the draining conduit such that it can be placed against an inlet port of the cleaning liquid container.

According to a preferred embodiment of the invention provision is made for the flow cross section of the draining conduit to be variable by means of at least one valve element in order to largely reduce the evaporation of cleaning liquid while the cleaning device is not being used. Starting from a valve element designed to cover the flow cross section, the flow cross section of the draining conduit is reduced by the valve element to a greater or lesser extent depending on the construction of said valve element.

In a further aspect of this embodiment provision is made for the valve element, when acted upon by the outflow of cleaning liquid, to essentially clear the flow cross section of the draining conduit. According to another embodiment of the invention the valve element can be arranged and constructed such that the valve element, when acted upon by a gaseous pressure above atmospheric occurring in the cleaning liquid container, clears at least a partial area of the flow cross section of the draining conduit and/or the pressure compensation conduit.

A further advantageous embodiment of the invention is characterized in that provision is made on the draining conduit and/or the pressure compensation conduit for a stop for abutment with the valve element in order to preferably achieve complete coverage of the respective flow cross section(s).

According to yet another embodiment of the invention provision is made for the flow cross section to be coverable at least in part by the valve element in the presence of a pressure balance between the draining conduit and the interior of the cleaning liquid container. This provision guarantees for certain embodiments of the invention that the cleaning liquid is reliably drained into the cleaning liquid container and that the gas volume accordingly needing to be displaced flows out of the interior of the cleaning liquid container.

According to another embodiment of the invention the effective area of the valve element is constructed to be smaller than the flow cross section.

According to a particularly advantageous embodiment of the invention provision is made for the valve element to be constructed as a flap valve controllable by gravity. This makes it possible, without impairing an effective draining of cleaning liquid into the cleaning liquid container and the accordingly necessary outflow of a gaseous medium from the interior of the cleaning liquid container, for the flow cross section of the draining conduit and/or the pressure compensation conduit to be effectively sealed by the valve element for those intervals of time between the cleaning device being used with a corresponding appliance of personal use such as a shaving apparatus.

According to a simple and economical embodiment of the invention provision is made for the valve element to be constructed of an elastic diaphragm. In a further embodiment of the invention the valve element is preferably provided on the sealing element. In an alternative embodiment of the invention the valve element is provided on the draining conduit.

In cases where a pressure compensation conduit is integrated in the draining conduit it is an advantage according to yet another embodiment of the invention for the one valve element to be assigned to the draining conduit and for the other valve element to be assigned to the pressure compensation conduit.

To largely reduce the evaporation of cleaning liquid when the cleaning device is not in use, meaning when it is switched off, a further preferred embodiment of the invention provides for the draining conduit to project into the cleaning liquid container, terminating at a relatively short distance to a maximum filling level of the cleaning liquid.

According to an alternative aspect a sealing element, which extends the draining conduit, projects into the cleaning liquid container and terminates at a relatively short distance to a maximum filling level of the cleaning liquid.

Yet another advantageous embodiment of the invention provides for the pressure compensation conduit to project into the cleaning liquid container and terminate at a relatively short distance to a maximum filling level of the cleaning liquid.

Further advantages and details of the present invention will become apparent from the subsequent description and the accompanying drawings illustrating a preferred embodiment of the invention.

Figure 5:
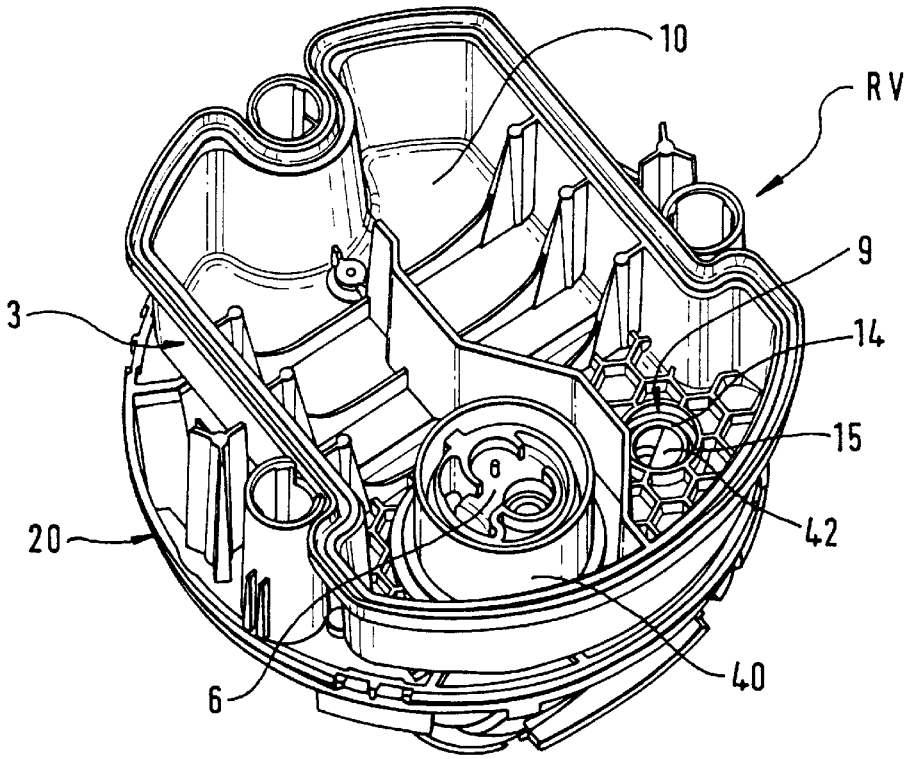
Figure 6:
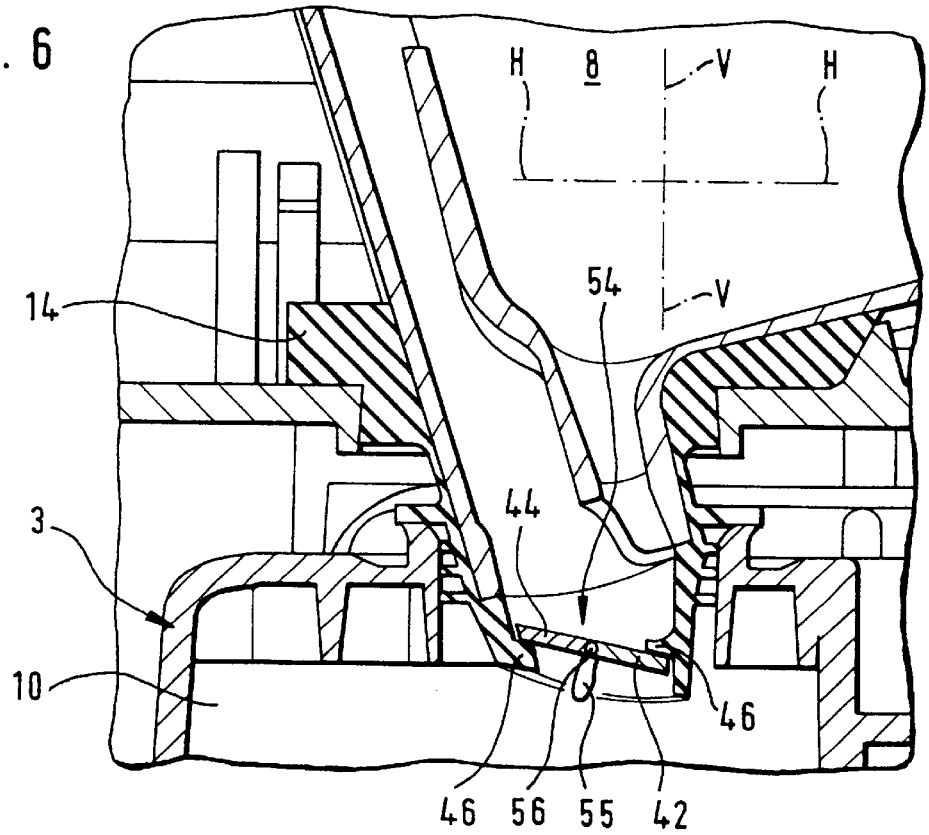

FIG. 5 is a sectional view, in perspective, of the chassis and the cleaning liquid container of the cleaning device, showing the lower end of a liquid impelling assembly provided in a filter housing and the inlet port for returning cleaning liquid into the cleaning liquid container; and FIG. 6 is a view of an embodiment of a draining conduit having a pushed-on sealing element and a gravity-controlled flap valve.

Figure 1:
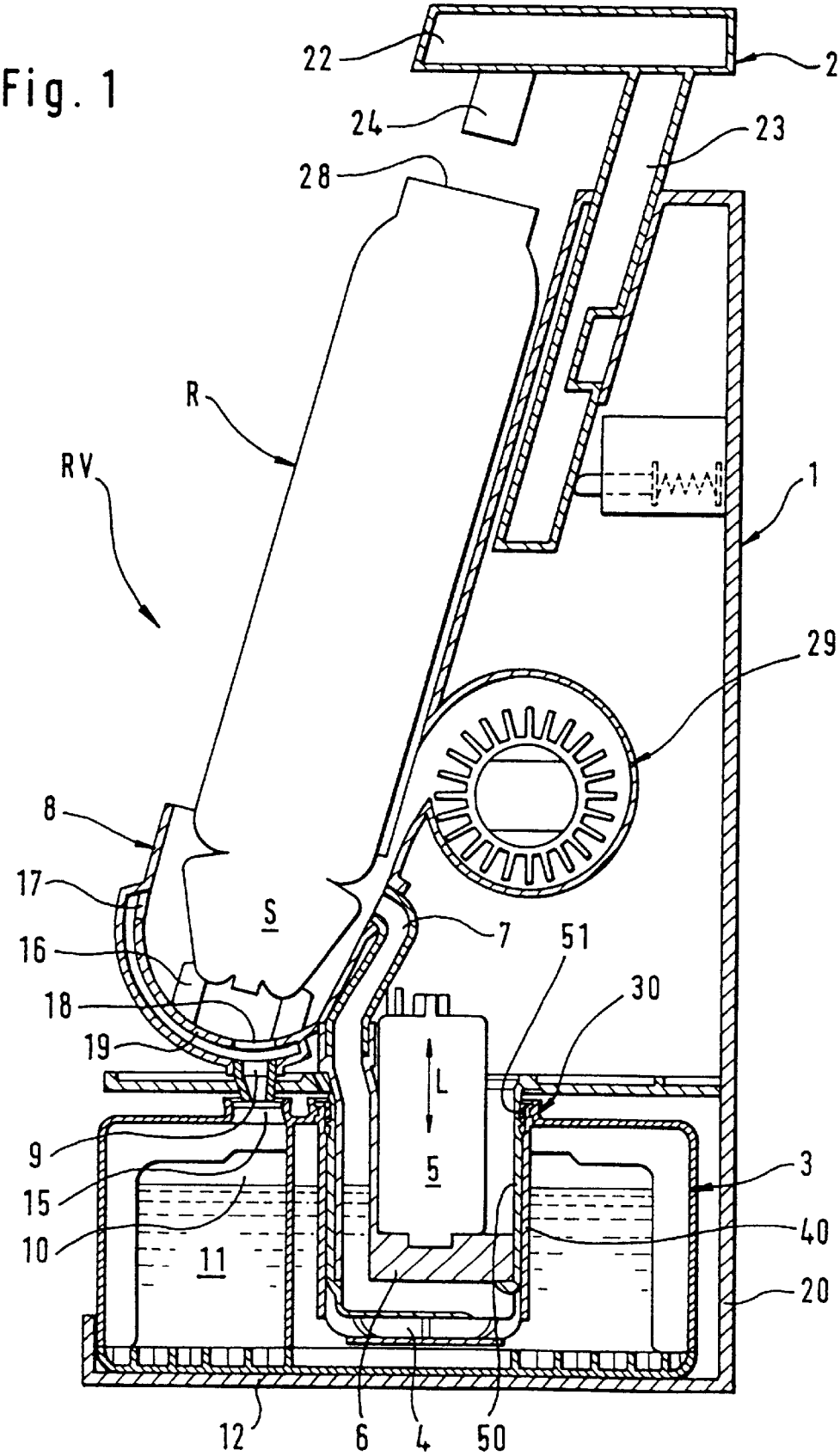
FIG. 1 is a cross sectional view of a cleaning device, comprising a cleaning liquid container with integrated filter beneath a cleaning bath, a liquid impelling assembly, a supply conduit to the cleaning bath in which a shaving head of a shaving apparatus is carried, and a draining conduit.

FIG. 1 shows a cross section through a cleaning device RV for cleaning a shaving head S of a shaving apparatus R, comprising a housing 1, a holding device 2, a cleaning liquid container 3, a filter element 4, a liquid impelling assembly 6 adapted to be driven by a motor 5 and having a supply conduit 7 leading to a cleaning bath 8 and a draining conduit 9 leading from the cleaning bath 8 to the cleaning liquid container 3. The cleaning liquid container 3 is arranged with an integrated filter element 4 underneath the cleaning bath 8 and above a wall 12 of the housing 1. The liquid impelling assembly 6 is arranged so that it can be removed from the interior 10 of the cleaning liquid container 3, meaning from the filter housing 40. Arranged between the filter housing 40 and the pump housing 50 is a sealing element 51 to prevent cleaning liquid 11 from flowing out of the cleaning liquid container 3.

The inner curvature of the cleaning bath 8 is shaped to conform approximately to the outer contour of the object to be cleaned, for example, the outer contour of a shaving head S of a shaving apparatus R. The cleaning bath 8 receives only as much cleaning liquid 11 as is required for the respective cleaning operation. Two support elements 16 made of an elastic material, for example, can be provided to support the shaving head S at the bottom of the cleaning bath 8. The cleaning bath 8 has an overflow device 17 to prevent the cleaning liquid 11 in the cleaning bath from exceeding a defined level. The overflow device 17 guarantees that, when the cleaning device RV is in operation, the shaving head S or a part of the shaving head S is immersed in cleaning liquid 11, and prevents cleaning liquid 11 from flowing over the brim of the cleaning bath 8. In this embodiment the draining of the cleaning liquid 11 from the cleaning bath 8 to the cleaning liquid container 3 is guaranteed by the outlet port 18 in the draining conduit 9 in the bottom 19 of the cleaning bath 8, the drain cross section of which can also be used to control the level of the cleaning liquid in the cleaning bath, and by an inlet port 15 constructed, for example, as a funnel in the cleaning liquid container 3. To be able to move the replaceable cleaning liquid container 3, the inlet port 15 and the outlet port 30 in the cleaning liquid container 3 can be closed as by means of a closure—not shown.

The shaving apparatus R is held in the cleaning bath 8 by an adjustably arranged holding device 2. The holding device 2 is essentially formed by a wall 23, which extends parallel to one broadside of the shaving apparatus R, and by a wall 22 facing the base wall of the shaving apparatus R. A retaining element 24 constructed as an appliance connector is provided on the wall 22. The wall 23 of the holding device 2, which is coupled to the wall 22, is slidably mounted in the housing 1, being movable for example, in a direction parallel to the housing broadside of the shaving apparatus R, such that moving the holding device 2 in the direction of the cleaning bath 8 invariably results in the retaining element 24, which is constructed as an appliance connector, being coupled to the appliance socket 28 of the shaving apparatus R, and moving the holding device 2 in the opposite direction invariably results in the holding device 2 being uncoupled from the shaving apparatus R. Coupling the appliance connector of the retaining element 24 to the appliance socket 28 effects, via connection to the electric circuit provided in the cleaning device RV for operating the liquid impelling assembly 6 and/or the fan 29, the supply of an electric voltage for a variety of purposes including, for example, a manually operated or automatically controlled actuation of the electric drive of the shaving apparatus R when the cleaning device RV is switched on, and/or a recharging of a shaving apparatus R, which is equipped with a rechargeable storage cell, after the cleaning device RV is switched off. Putting the shaving apparatus R into operation during the cleaning cycle promotes, as a result of the oscillating movement of a cutting element provided in the shaving head S of the shaving apparatus R and the ensuing agitation of the cleaning liquid 11 in the shaving head S, the cleaning effect of the cleaning liquid 11.

Provided in the cleaning device RV is a fan 29 that supplies air to dry the shaving head S, shown by way of example, after cleaning is completed, i.e., after the cleaning liquid 11 is drained from the cleaning bath 8. Activation and deactivation of the fan 29 can be controlled as part of an operating program of a programmable switching device—not shown—and/or separately by hand.

Figure 2:
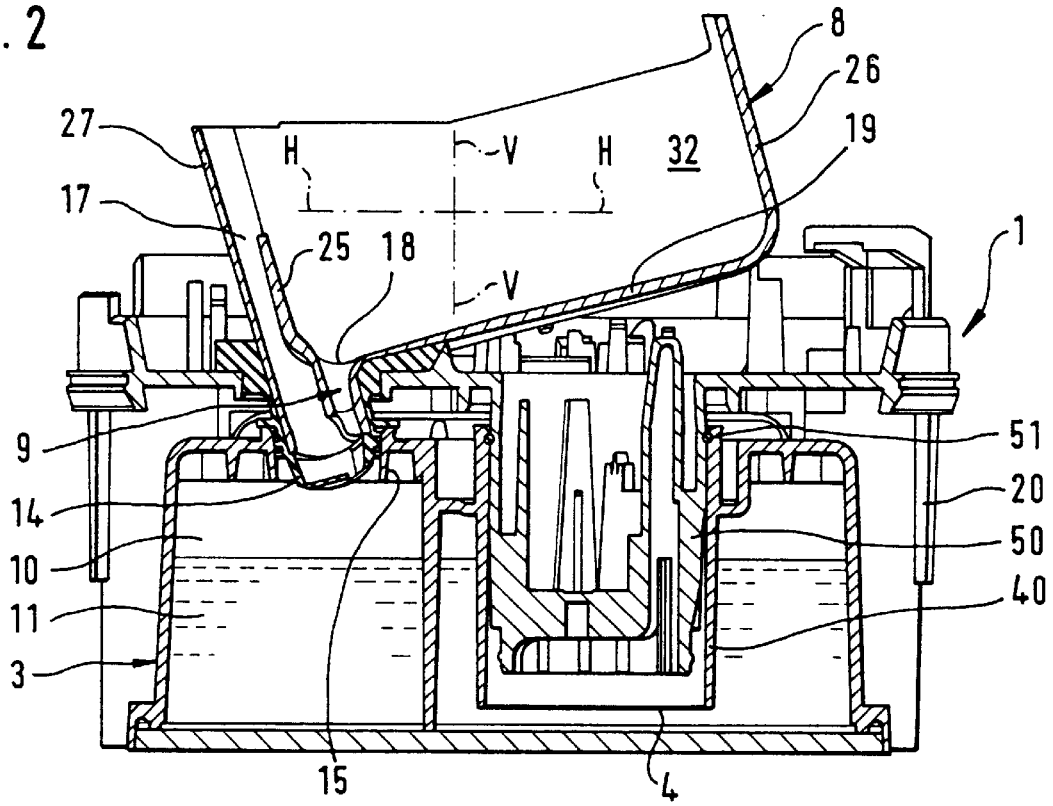
FIG. 2 is a longitudinal sectional view of the lower part of a cleaning device, in particular of a cleaning bath and a cleaning liquid container, with sealing elements for sealing an inlet port and an outlet port of the cleaning liquid container.

FIG. 2 shows a side view of the cleaning device RV with a longitudinal section through the chassis 20 of the housing 1, i.e., it shows a higher level of cleaning liquid in a cleaning liquid container 3 arranged on the chassis 20 and a cleaning bath 8 arranged on the chassis 20 at an angle to a horizontal plane. The angle of inclination of the cleaning bath 8 as well as of the bottom 19 of the cleaning bath 8 to the horizontal plane H results in fast draining of the cleaning liquid, i.e., it leads to a higher flow velocity. At the lower end of the bath bottom 19 is the outlet port 18 of the draining conduit 9 in the bath bottom 19. In the embodiment illustrated in FIG. 2 the draining conduit 9 is divided by a wall 25 of the overflow device 17 into two opening areas, with the opening in the bath bottom 19 in front of the wall 25 of the overflow device 17 being dimensioned such that the cleaning liquid, which contains contaminants, can be drained unobstructed into the cleaning liquid container 3 without clogging said opening. The section through the cleaning bath 8 clearly reveals that, like the inclined bath bottom 19, the two end walls 25, 26 of the cleaning bath 8 also extend at an angle to the horizontal plane H, hence guaranteeing that cleaning liquid 11 is also drained from these end walls 25, 26 of the cleaning bath 8.

The draining conduit 9 is surrounded by a sealing element 14 that is pushed onto the lower end of the draining conduit 9 and held in place by its inherent tension. The cleaning bath 8 is arranged to move to and fro in vertical direction together with the chassis 20 in the cleaning device RV. The arrangement of the cleaning liquid container 3 in the chassis 20 of the housing 1 is such that, when the cleaning bath 8 and the cleaning liquid container 3 are assembled together, the draining conduit 9 with the sealing element 14 is introduced through the inlet port 15 into the interior 10 of the cleaning liquid container 3 until the sealing element 14 engages the brim of the inlet port 15 in sealing relationship therewith. With the cleaning bath 8 and the cleaning liquid container 3 thus joined, only the flow cross section of the draining conduit 9 provides for communication between the interior 10 of the cleaning liquid container 3 and the environment of the cleaning device RV. The flow cross section of the draining conduit 9 is dimensioned such that, during operation of the cleaning device RV, cleaning liquid is allowed to be drained unobstructed into the interior 10 of the cleaning liquid container 3 both via the provided outlet port 18 and over the overflow wall 25, while the gaseous medium present in the interior and displaced proportionally to this supply of cleaning liquid is allowed to escape unobstructed via the draining conduit 9. If these criteria are fulfilled, the flow cross section of the draining conduit 9 can be kept relatively small, and with it the loss of cleaning liquid due to evaporation when the cleaning device RV is not in use.

Figure 3:
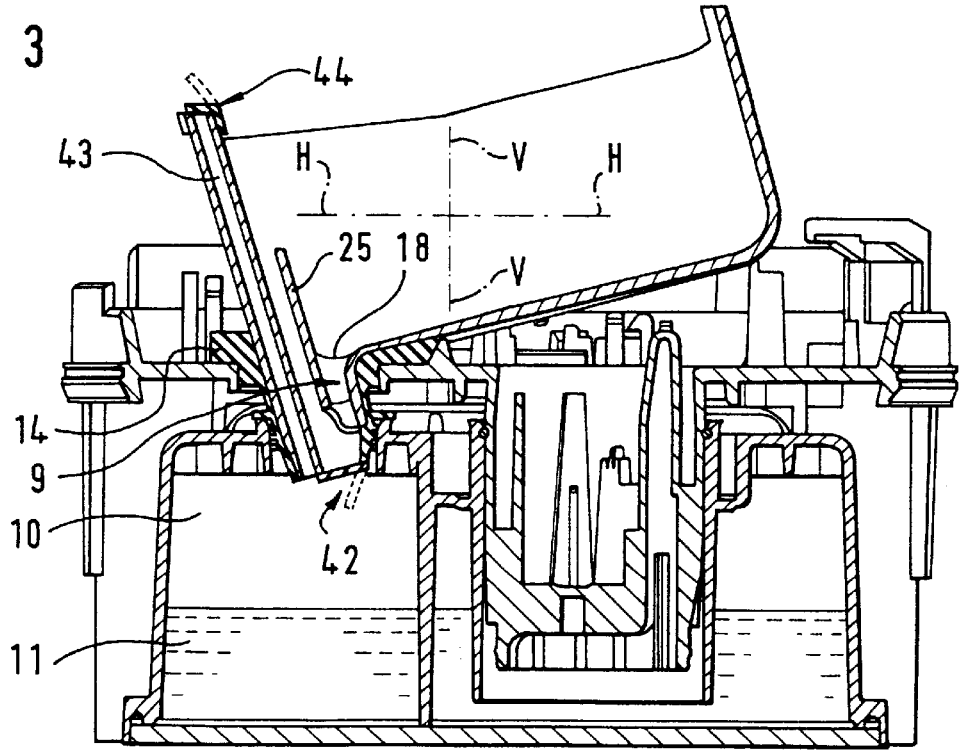
FIG. 3 is a longitudinal sectional view of the lower part of a cleaning device of FIG. 2, comprising a pressure compensation conduit associated with the draining conduit.

FIG. 3 shows a longitudinal section through the lower part of the cleaning device RV of FIG. 2, comprising a pressure compensation conduit 43 associated with the draining conduit 9. The pressure compensation conduit 43 can be provided, for example, directly on the outer wall of the draining conduit 9 or, alternatively, as an integral component of the draining conduit 9 within its flow cross section. An essential advantage of these alternative embodiments is that the sealing element 14 can be used to seal both the draining conduit 9 and the pressure compensation conduit 43. In a further alternative embodiment in which the pressure compensation conduit 43 is provided separate from the draining conduit 9, the pressure compensation conduit would need to be sealed with an additional sealing element—not shown.

In the embodiment of FIG. 3 the pressure compensation conduit 43 is a component of the draining conduit 9 and accordingly integrated in its flow cross section. As such, a sealing element 14 surrounding the lower end of the draining conduit 9 seals at the same time the pressure compensation conduit 43 against the cleaning liquid container 3. In the area of the outlet port 18 of the cleaning bath 8 the flow cross section of the draining conduit 9 is divided by the overflow wall 25 and the wall of the pressure compensation conduit 43, which is constructed as a length of pipe, into three mutually separate flow channels, such that cleaning liquid 11 is allowed to drain freely into the interior 10 of the cleaning liquid container 3 via the outlet port 18 and over the overflow wall 25, while gaseous medium is allowed to escape from there into atmosphere via the pressure compensation conduit 43 in accordance with the displacement principle. Provided on the end of the sealing element 14 projecting into the interior 10 is a valve element 42 enabling part of the flow cross section of the draining conduit 9 to be closed, which is made up of the channel adjoining the outlet port 18 and the channel formed by the overflow wall 25. The area of flow cross section of the draining conduit 9 occupied by the pressure compensation conduit 43 is of an open construction at the end projecting into the interior of the cleaning liquid container, while at the opposite end of the pressure compensation conduit 43 provision is made for a valve element 44 that closes the flow cross section of the pressure compensation conduit 43. The valve element 42 can be constructed as an elastic diaphragm and be formed either on the draining conduit 9 or, as illustrated in FIG. 3, on the sealing element 14. The forming can be such that the valve element is not opened with an additional spring but only as the result of its own elastic properties under the action of cleaning liquid 11 draining from the cleaning bath 8, and that it automatically springs back to its closing position on completion of this operation. An equivalent design can be provided for the valve element 44 arranged on the pressure compensation conduit 43. The valve element 44 can be constructed, for example, from an elastic ring element having an elastic diaphragm formed thereon, which is adapted to be pushed onto a length of pipe.

In the embodiment of FIG. 3, the function of the valve elements 42 and 43 is such that first the valve element 42 opens on account of cleaning liquid 11 being drained from the cleaning bath, then the valve element 44 opens under the action of the escaping current of displaced gaseous medium and, after the outflow of cleaning liquid 11 from the cleaning bath 8 is terminated, both the valve element 42 and the valve element 44 close the respective area of flow cross section of the draining conduit 9 and the pressure compensation conduit 43, so that with the cleaning device RV no longer being used, the interior 10 of the cleaning liquid container 3 is closed off from atmosphere.

Figure 4:
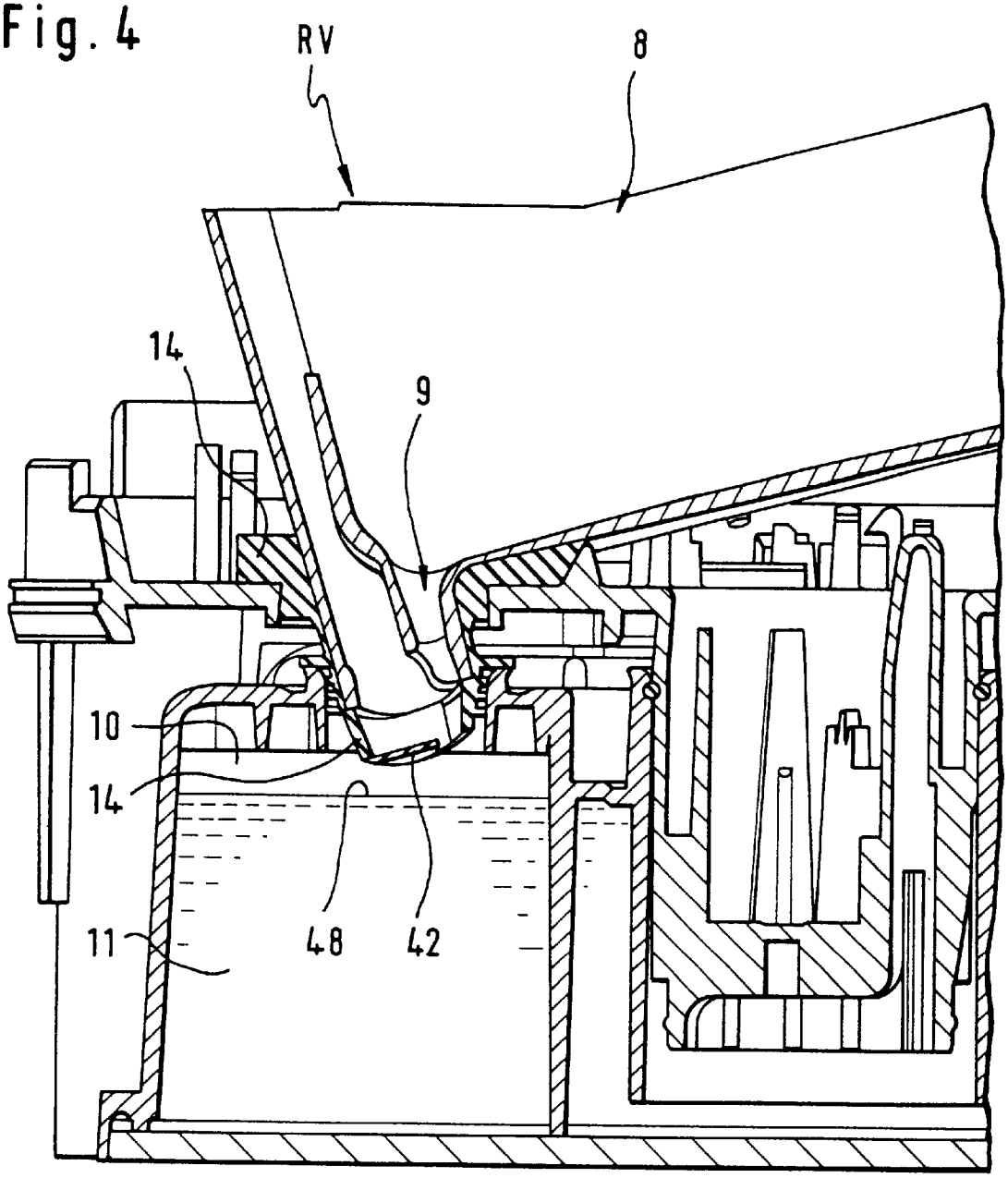
FIG. 4 is a longitudinal sectional view of a portion of the lower part of a cleaning device, showing on an enlarged scale the sealing element provided between the draining conduit of the cleaning bath and the inlet port of the cleaning liquid container.

FIG. 4 shows a longitudinal section through a portion of the lower part of a cleaning device RV, illustrating the sealing element 14 provided between the draining conduit 9 of the cleaning bath 8 and the inlet port 15 of the cleaning liquid container 3, in accordance with the embodiment of FIG. 2. The draining conduit 9 projects with the sealing element 14, which extends the draining conduit 9, into the interior 10 of the cleaning liquid container 3, with the distance between the lower end of the sealing element 14 and the liquid level 48 being that adopted by the cleaning liquid 11 in a still unused state—state as delivered. This provision leads to a reduction in the loss of cleaning liquid 11 provided that, when the cleaning device is not being used, the flow cross section of the draining conduit and the sealing element 14 is not completely open but only partly cleared by a valve element. A valve element 42 only partly covering the cross sectional opening of the draining conduit 9 or sealing element 14 is provided and illustrated in the embodiment of in FIG. 4. The valve element 42 is integrally formed, for example, as an elastic diaphragm, on the sealing element 14 and reduces part of the cross sectional area required both for the supply of cleaning liquid 11 and for the outflow of the gaseous volume present in the cleaning liquid container.

FIG. 5 shows a section through the chassis 20 as well as through the cleaning liquid container 3 of the cleaning device RV of FIG. 4, in a perspective view as seen when looking onto the lower end of a liquid impelling assembly 6 provided in a filter housing 40 and onto the inlet port 15 of the cleaning liquid container 3 for the return of cleaning liquid into the interior 10 of the cleaning liquid container 3. Formed on the sealing element 14 is a valve element 42 that covers, for example, half of the flow cross section of the draining conduit 9 or of the sealing element 14.

FIG. 6 shows an embodiment of a draining conduit 9 with a sealing element 14 pushed on it, in which provision is made for a flap valve controlled by gravity. Provided on the inner wall of the sealing element 14 are stops 45 and 46 for abutment by the valve elements 42 and 44 of the flap valve 54 by gravity control when the cleaning device RV is not being used. The valve elements 42 and 44 are arranged in the flow cross section of the draining conduit 9 and the sealing element 14 for pivotal movement about a pivot axis 56 at an inclination to a horizontal plane H, provision being made for a weight 55 arranged at an inclination to a vertical direction V to effect the gravity control of the valve elements 42 and 44. The arrangement of the stops 45 and 46 on the sealing element 14 is such that, under the action of cleaning liquid 11 draining from the cleaning bath, the valve element 42 pivots about the pivot axis 56 away from the stop 46 into the interior 10 of the cleaning liquid container, whereas the valve element 44, induced by the pressure above atmospheric developing in the cleaning liquid container, pivots likewise about the pivot axis 56 away from the stop 45 into the flow channel of the sealing element 14 and into the draining conduit 9 in order to allow the gaseous medium to escape into atmosphere. When draining of cleaning liquid from the cleaning bath 8 into the interior 10 of the cleaning liquid container 3 has ended, the valve elements 42 and 44, which are in the open position, return under the action of the weight 55 to their closed position, i.e., up until abutment with the stops 45 and 46. When the valve elements 42 and 44 are in abutment with the stops 45 and 46, the interior 10 of the cleaning container 3 is completely closed off from atmosphere.

What is claimed is:

1. A cleaning device (RV) comprising:

a housing;

a cleaning bath for receiving an appliance of personal use; and a replaceably arranged cleaning liquid container having an inlet port and an outlet port, a sealing element for sealing the outlet port, a motor, a liquid impelling assembly adapted to be driven by said motor for propelling a cleaning liquid from the cleaning liquid container into the cleaning bath, said cleaning bath having a draining conduit adapted to be coupled to the inlet port of the cleaning liquid container, said cleaning device further comprising a sealing element between the draining conduit and the inlet port, wherein the draining conduit has a flow cross section dimensioned such as to enable the cleaning liquid with contaminants to drain into the cleaning liquid container and gaseous medium to escape from the cleaning liquid container.

2. The cleaning device as claimed in claim 1, further comprising a pressure compensation conduit associated with the draining conduit.

3. The cleaning device as claimed in claim 2, wherein the pressure compensation conduit is an integral component of said draining conduit.

4. The cleaning device as claimed in claim 2, wherein the pressure compensation conduit is formed by a length of pipe.

5. The cleaning device as claimed in claim 2, wherein a stop is provided in one of the draining conduit and the pressure compensation conduit, said stop for abutment with the valve element.

6. The cleaning device as claimed in claim 2, wherein the pressure compensation conduit projects into the cleaning liquid container and terminates at a relatively short distance to a maximum filling level of the cleaning liquid.

7. The cleaning device as claimed in claim 1, wherein the cleaning bath includes an overflow wall that projects into the draining conduit.

8. The cleaning device as claimed in claim 7, wherein the flow cross section of the draining conduit is divided by the pressure compensation conduit and the overflow wall into three flow channels.

9. The cleaning device as claimed in claim 1, wherein the draining conduit has an outer wall in which provision is made for the sealing element that is adapted to be placed against the inlet port of the cleaning liquid container.

10. The cleaning device as claimed in claim 1, wherein said cleaning bath has a valve element the varies the flow cross section of the draining conduit.

11. The cleaning device as claimed in claim 10, wherein an outflow of cleaning liquid acts upon the valve element, and when acted upon by the outflow of cleaning liquid, the valve element clears the flow cross section of the draining conduit.

12. The cleaning device as claimed in claim 10, wherein the valve element, when acted upon by a gaseous pressure above atmospheric occurring in the cleaning liquid container, clears at least a partial area of the flow cross section of the draining conduit.

13. The cleaning device as claimed in claim 10, wherein the flow cross section is coverable at least in part by the valve element in the presence of a pressure balance between the draining conduit and the interior of the cleaning liquid container.

14. The cleaning device as claimed in claim 10, wherein the valve element has an effective area that is constructed to be smaller than the flow cross section.

15. The cleaning device as claimed in claim 10, wherein the valve element comprises a flap valve that is controllable by gravity.

16. The cleaning device as claimed in claim 10, wherein the valve element comprises an elastic diaphragm.

17. The cleaning device as claimed in claim 10, wherein the valve element is provided on the sealing element.

18. The cleaning device as claimed in claim 10, wherein the valve element is provided on the draining conduit.

19. The cleaning device as claimed in claim 10, wherein said cleaning bath includes a second valve element, and wherein the first mentioned valve element is assigned to the draining conduit and the second valve element is assigned to the pressure compensation conduit.

20. The cleaning device as claimed in claim 1, wherein the draining conduit projects into the cleaning liquid container, terminating at a relatively short distance to a maximum filling level of the cleaning liquid.

21. The cleaning device as claimed in claim 1, wherein the sealing element extends the draining conduit and projects into the cleaning liquid container and terminates at a relatively short distance to a maximum filling level of the cleaning liquid.

* * * * *

UNITED STATES PATENT AND TRADEMARK OFFICE

CERTIFICATE OF CORRECTION

PATENT NO. : 6,640,819 B2
DATED : November 4, 2003
INVENTOR(S) : Jurgen Hoser and Alf Jahn It is certified that error appears in the above-identified patent and that said Letters Patent is hereby corrected as shown below:

Column 8,
Line 22, delete “the varies” and insert -- that varies --

Signed and Sealed this

Eleventh Day of May, 2004

JON W. DUDAS
*Acting Director of the United States Patent and Trademark Office*